US010280028B2

(12) United States Patent
Yu Chen

(10) Patent No.: US 10,280,028 B2
(45) Date of Patent: May 7, 2019

(54) DESKTOP ADHESIVE TAPE BINDING AND CUTTING PLATFORM

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 129 days.

(21) Appl. No.: 15/369,787

(22) Filed: Dec. 5, 2016

(65) Prior Publication Data

US 2018/0155148 A1 Jun. 7, 2018

(51) Int. Cl.
*B65H 35/00* (2006.01)
*B65H 35/06* (2006.01)

(52) U.S. Cl.
CPC ..... *B65H 35/0026* (2013.01); *B65H 35/06* (2013.01); *B65H 2301/51532* (2013.01); *B65H 2402/10* (2013.01)

(58) Field of Classification Search
CPC . B65H 35/0026; B65H 35/06; B65H 2601/30
See application file for complete search history.

(56) References Cited

U.S. PATENT DOCUMENTS 666,261 A * 1/1901 Butterworth ..... B65H 35/0026 206/411
851,832 A * 4/1907 Patterson ..... B65H 35/0026 225/33
892,077 A * 6/1908 Osterhoudt ..... B65H 35/0026 223/106
1,123,830 A * 1/1915 Zincke ..... B65H 35/0026 225/44
1,159,619 A * 11/1915 Taylor ..... B65H 35/0026 225/22
2,275,408 A * 3/1942 Alliss ..... B65H 35/0026 225/25
2,300,423 A * 11/1942 Holben ..... B65H 35/0026 225/25
2,400,776 A * 5/1946 Nordeen ..... B65H 35/0026 225/74
2,414,333 A * 1/1947 Schieman ..... B65D 85/672 225/45
2,434,776 A * 1/1948 Cleef ..... B65H 35/0026 225/21
2,447,145 A * 8/1948 Cleef ..... B65H 35/0026 225/18
2,450,496 A * 10/1948 Whiteley ..... B65H 35/0006 242/594.3
2,453,028 A * 11/1948 Mason ..... B65H 35/0026 225/25
2,463,445 A * 3/1949 Cleef ..... B65H 35/0026 225/21

(Continued)

*Primary Examiner* — Sean M Michalski
(74) *Attorney, Agent, or Firm* — Bruce Stone LLP; Joseph Bruce

(57) ABSTRACT

A desktop adhesive tape binding and cutting platform includes a fundamental base provided with a connecting plate. The fundamental base is pivotally provided with a rotating shaft for installing an adhesive tape roll thereon. A binding platform is connected with the free end of the connecting plate, and a cutting portion is connected with the binding platform and has its free end provided with a cutting member and a fixing member. Thus, during binding operation, the desktop adhesive tape binding and cutting platform of this invention is able to cut off adhesive tape via the cutting member and meanwhile fix the adhesive tape in place via the fixing member.

10 Claims, 12 Drawing Sheets

(56) References Cited

U.S. PATENT DOCUMENTS

RE23,129 E * 6/1949 Borden ..... B65H 35/0026 225/25
2,477,014 A * 7/1949 Stanley ..... B65H 35/0006 248/223.41
2,555,747 A * 6/1951 Winsor ..... B65H 35/0026 118/43
2,640,657 A * 6/1953 Reynolds ..... B65H 35/0026 225/25
2,652,115 A * 9/1953 Mysels ..... B65H 35/0026 225/16
2,677,425 A * 5/1954 Broyles ..... B65H 35/0026 225/26
2,698,143 A * 12/1954 Pottle ..... B65H 35/0026 225/25
3,265,264 A * 8/1966 Stephens ..... B65H 35/0026 225/25
3,348,524 A * 10/1967 Butler ..... B65H 35/0026 118/43
3,403,869 A * 10/1968 Marchisen ..... B65H 35/0026 206/408
3,466,963 A * 9/1969 Hawes ..... B65H 35/0026 225/16
3,468,743 A * 9/1969 Soriano ..... B65H 35/0026 156/527
3,472,724 A * 10/1969 Casey ..... B65H 35/0026 156/521
3,484,030 A * 12/1969 Mattheis ..... B65H 35/0026 225/65
3,498,512 A * 3/1970 Golemon ..... B65H 35/0026 225/21
3,502,252 A * 3/1970 Mariani ..... B65H 35/0026 225/33
3,508,692 A * 4/1970 Holtan ..... B65H 35/0026 225/33
3,521,800 A * 7/1970 Stephens ..... B65H 35/0026 225/21
3,533,616 A * 10/1970 Bettenhausen .... B65H 35/0026 493/338
3,696,980 A * 10/1972 Waltz ..... B65H 35/0026 225/66
3,700,151 A * 10/1972 Youngstrom ..... B65H 35/0026 225/26
3,725,182 A * 4/1973 Regan ..... B65H 35/0026 156/517
3,727,868 A * 4/1973 Buchanan ..... B65H 35/0026 242/588.3
3,743,151 A * 7/1973 Malcolm ..... B65H 35/002 225/47
3,762,261 A * 10/1973 Ekenberg ..... B65H 35/002 225/43
3,768,713 A * 10/1973 Lash ..... A47F 13/04 225/34
3,989,175 A * 11/1976 Cherrin ..... B65H 35/0026 225/46
3,993,230 A * 11/1976 Oakes ..... B65H 35/0026 206/815
4,059,210 A * 11/1977 Deering, Jr. ..... B65H 35/0026 225/47
4,222,509 A * 9/1980 Smith ..... B65H 35/0026 225/77
4,320,835 A * 3/1982 Polhemus ..... B65H 35/0026 206/214
4,349,142 A * 9/1982 Soter, III ..... B27F 7/006 112/153
4,417,677 A * 11/1983 Mead ..... B65H 35/0026 225/26
4,437,854 A * 3/1984 Knoop ..... B65H 35/0026 225/25
4,752,023 A * 6/1988 Lin ..... B65H 35/0026 225/26
4,824,427 A * 4/1989 Smillie, III ..... B65H 35/0026 225/25
4,884,734 A * 12/1989 Kahl, Jr. ..... B65H 35/0026 225/26
4,957,235 A * 9/1990 Beno ..... B26D 1/30 108/25
4,978,330 A * 12/1990 Suhr ..... B65H 35/0026 225/25
4,979,414 A * 12/1990 Caveney ..... B65H 35/0026 225/21
5,228,612 A * 7/1993 Kuo ..... B65H 35/0026 225/47
5,433,467 A * 7/1995 Easterwood ..... B60D 1/60 280/504
5,624,527 A * 4/1997 Maresh ..... B29C 53/48 156/466
5,954,257 A * 9/1999 Panneri ..... B65H 35/0026 225/39
6,085,955 A * 7/2000 Hicks ..... B65H 35/0026 225/42
6,152,344 A * 11/2000 Jensen ..... B65H 35/0026 225/12
6,481,607 B1 * 11/2002 Van Cott ..... B65H 35/0026 225/46
6,502,616 B1 * 1/2003 Row ..... B65H 35/0006 156/463
D541,864 S * 5/2007 Porcini ..... B65H 35/0006 D19/69

* cited by examiner

DESKTOP ADHESIVE TAPE BINDING AND CUTTING PLATFORM

BACKGROUND OF THE INVENTION

1. Field of the Invention

This invention relates to an adhesive tape binding and cutting platform, particularly to a desktop adhesive tape binding and cutting platform.

2. Description the Prior Art

Generally, a conventional desktop adhesive tape binding and cutting bench includes a platform having two sides respectively provided with a reel and a blade. In use, an adhesive tape roll is first installed on the reel and the adhesive face of the adhesive tape facing upward is pulled out and paved flatly on the platform. Then, an article to be bound is held with one hand and laid on the platform for carrying out binding operation in a winding around and sticking way and lastly, the bound article together with the adhesive tape is pulled to the blade to have the adhesive tape pressed down and cut off to finish binding operation. In this way, another article to be bound can be held on the platform for carrying out successive binding operation.

However, since the adhesive face of the adhesive tape faces upward; therefore, the free end of the adhesive tape is impossible to be temporarily stuck to the blade and likely to move freely and in this case, a user needs to pull the adhesive tape with one hand and hold the article to be bound with another hand for carrying out binding operation, thus, inconvenient in operation, apt to render a user's fingers stuck to the adhesive face of the adhesive tape and likely to let the adhesive tape stuck backwards and hence lowering efficiency of binding operation. Further, the conventional desktop adhesive tape binding and cutting bench is fixed in shape and size so it is inapplicable to different-shaped and different-sized articles to be bound. Therefore, the inventor of this invention has observed foresaid drawbacks and thinks that the conventional desktop adhesive tape binding and cutting bench has to be ameliorated and hence devises this invention.

SUMMARY OF THE INVENTION

The objective of this invention is to offer a desktop adhesive tape binding and cutting platform, able to carry out binding operation conveniently and fix the adhesive tape in place to avoid the adhesive tape being stuck backwards during binding operation.

The desktop adhesive tape binding and cutting platform in the present invention includes a tape dispensing portion containing a fundamental base, which has a first side provided with a connecting plate and is pivotally provided with a rotating shaft for installing an adhesive tape roll thereon. A binding platform has two ends respectively defined to be a first connecting portion and a second connecting portion, with the first connecting portion connected with the free end of the connecting plate. A cutting portion is connected with the second connecting portion and has its free end fixed thereon with a cutting member and a fixing member.

The desktop adhesive tape binding and cutting platform of this invention carries out dispensation of adhesive tape via the tape dispensing portion, binding an article via the binding platform and cutting off the adhesive tape via the cutting member and after finishing binding operation, the adhesive tape can be fixed in place via the fixing member to avoid the adhesive tape being stuck backwards. By so designing, the desktop adhesive tape binding and cutting platform of this invention is able to enhance efficiency of binding operation.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
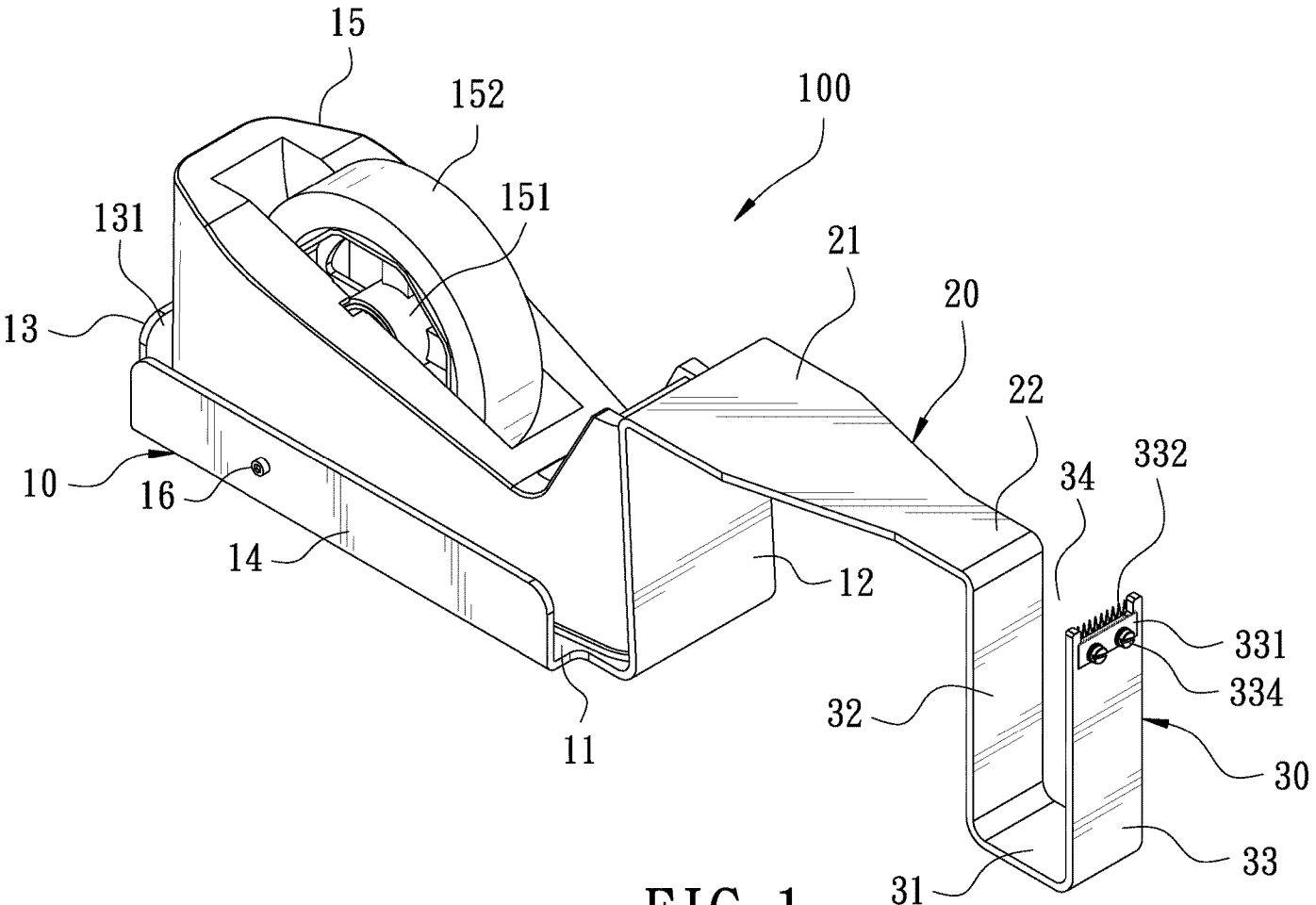
FIG. 1 is a perspective view of a first preferred embodiment of a desktop adhesive tape binding and cutting platform in the present invention.
Figure 2:
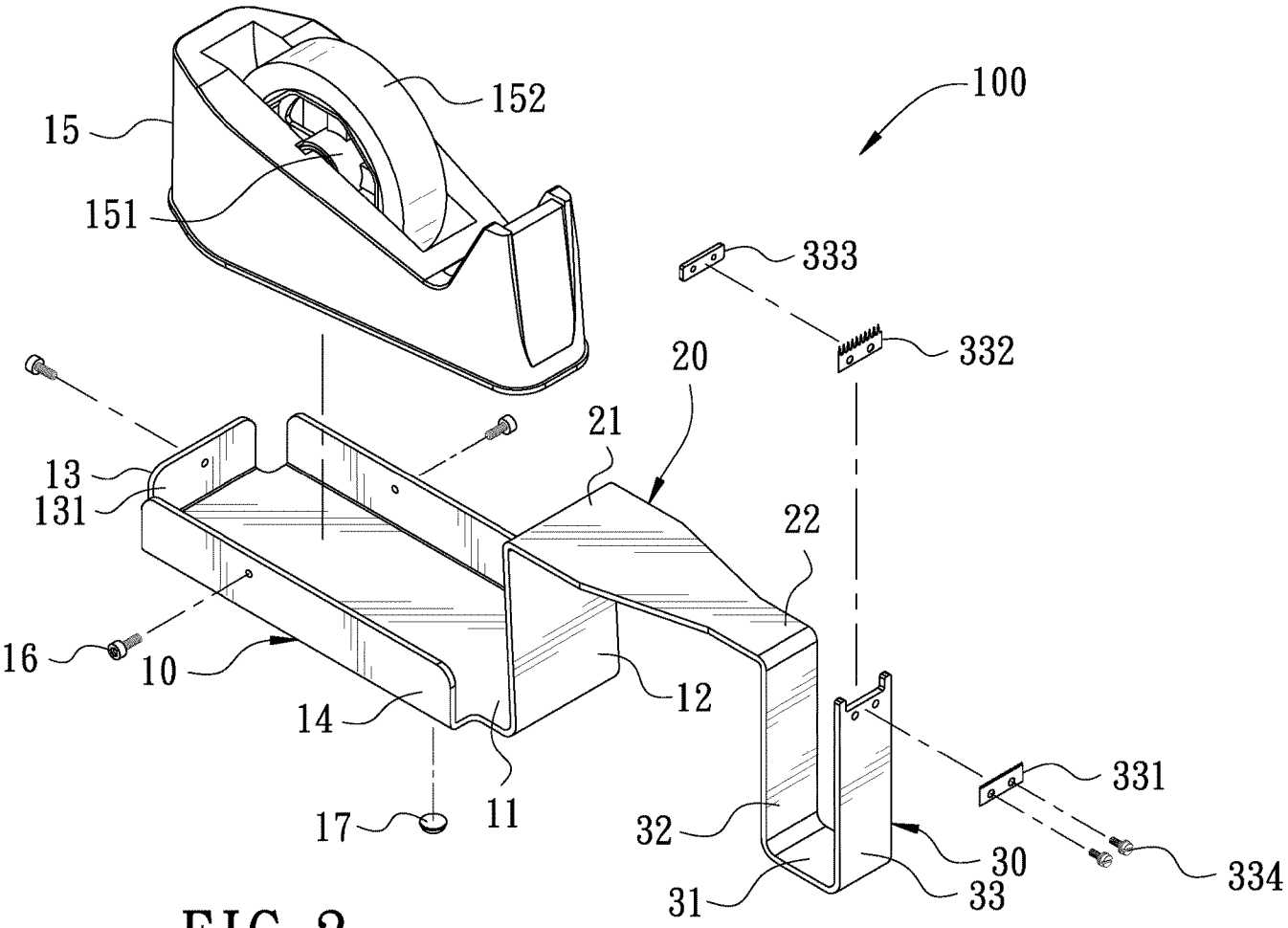
FIG. 2 is an exploded perspective view of the first preferred embodiment of the desktop adhesive tape binding and cutting platform in the present invention.
Figure 3:
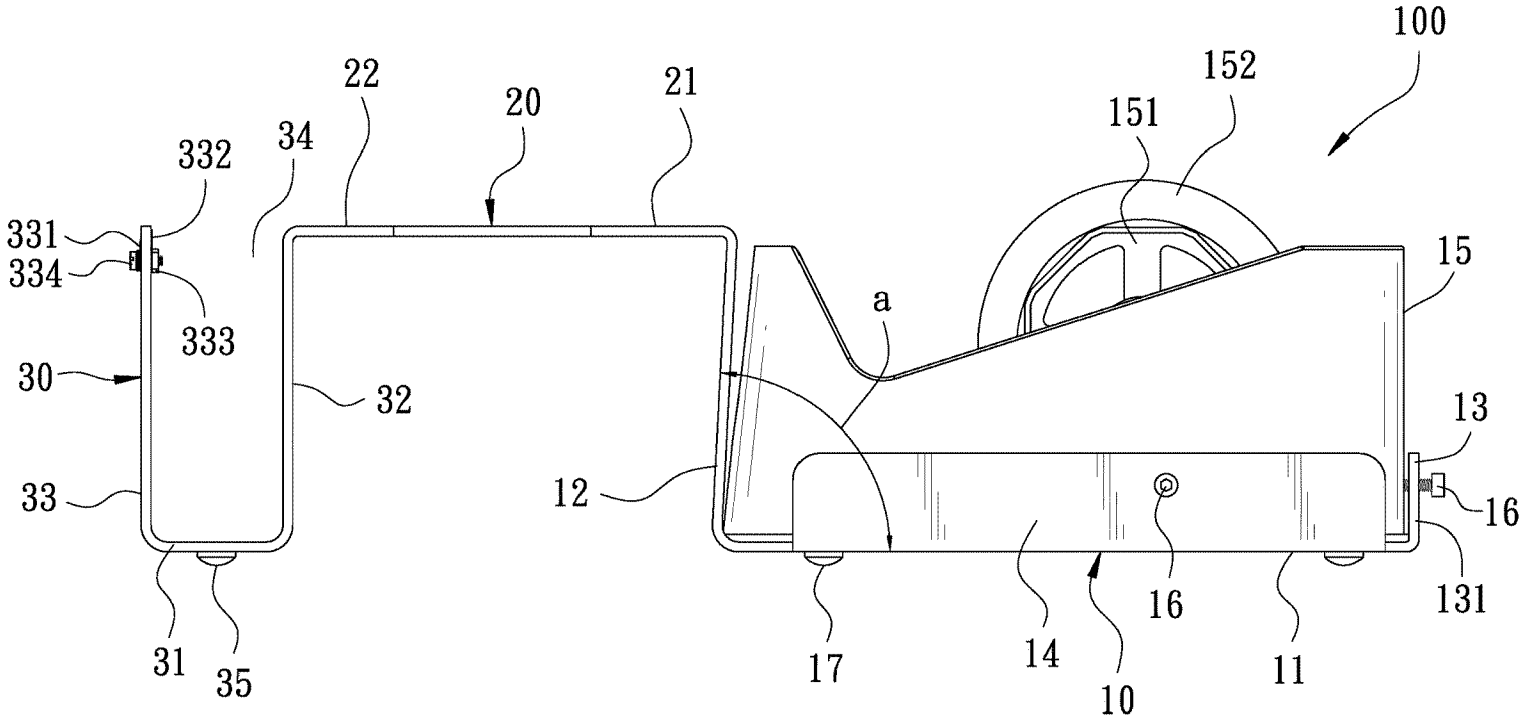
FIG. 3 is a side view of the first preferred embodiment of the desktop adhesive tape binding and cutting platform in the present invention.

A first preferred embodiment of a desktop adhesive tape binding and cutting platform 100 in the present invention, as shown in FIGS. 1-3, includes a tape dispensing portion 10, a binding platform 20 and a cutting portion 30 as main components combined together.

The tape dispensing portion 10 contains a fundamental base 11 having a first side provided with a connecting plate 12, which slants toward the fundamental base 12, with an angle (a), somewhat less than 90 degrees, defined between the connecting plate 12 and the fundamental base 11. The fundamental base 11 has a second side provided with a positioning member 13 containing a positioning plate 131. Further, the fundamental base 11 is provided with two side plates 14 spaced apart and positioned between the connecting plate 12 and the positioning member 13 and in this preferred embodiment, the fundamental base 11 is installed with an adhesive tape holder 15 among the connecting plate 12, the positioning member 13 and the two side plates 14, and the adhesive tape holder 15 is pivotally provided with a rotating shaft 151 for an adhesive tape roll 152 to be mounted thereon. The positioning member 13 and the two side plates 14 are respectively provided with a forcing-and-tightening member 16, which can be a screw or a rotary knob, for forcing and tightening the adhesive tape holder 15. The fundamental base 11 further has an underside fixed with a first anti-skid piece 17.

The binding platform 20 is a horizontal plate, having two ends respectively defined to be a first connecting portion 21 and a second connecting portion 22, with the first connecting portion 21 connected with the free end of the connecting plate 12.

Figure 4A:
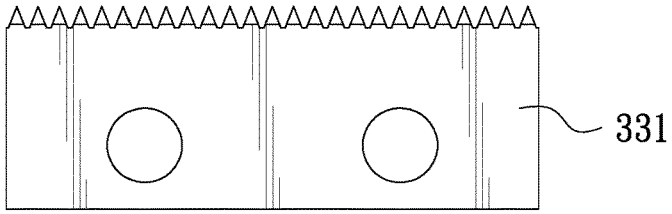
FIGS. 4A and 4B are front views of a cutting member and a fixing member of the first preferred embodiment of the desktop adhesive tape binding and cutting platform in the present invention.
Figure 4B:
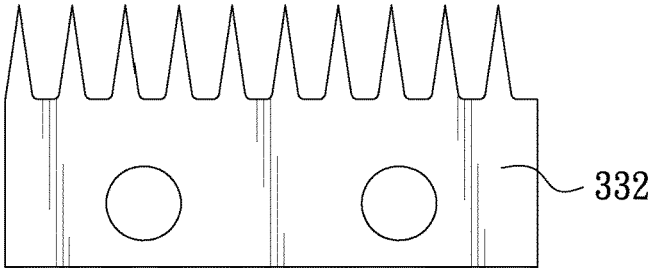

The cutting portion 30 is a U-shaped plate, formed with a base plate 31 having two sides respectively and longitudinally provided with a first vertical plate 32 and a second vertical plate 33, with the first vertical plate 32 connected with the second connecting portion 22 and having a space 34 formed among the base plate 31, the first vertical plate 32 and the second vertical plate 33. The second vertical plate 33 has its free end provided with a cutting member 331, a fixing member 332 and a retaining plate 333. The cutting member 331 is positioned at the outer side of the second vertical plate 33, while the fixing member 332 and the retaining plate 333 are positioned at the inner side of the second vertical plate 33, and the cutting member 331, the fixing member 332 and the retaining member 333 are firmly fixed at the second vertical plate 33 by means of screwing members 334. Referring to FIGS. 4A and 4B, the cutting member 331 is a cutting blade, while the fixing member 332 is an inserting-and-fixing blade, and both the cutting member 331 and the fixing member 332 are serrated blades. The ratio of tooth height to tooth width of the cutting member 331 is less than the ratio of tooth height to tooth width of the fixing member 332, and the teeth of the cutting member 331 are lower than those of the fixing member 332. Further, the base plate 31 has an underside provided with a second anti-skid piece 35.

In the first preferred embodiment of this invention, the tape dispensing portion 10, the binding platform 20 and the cutting portion 30 are formed integral.

Figure 5:
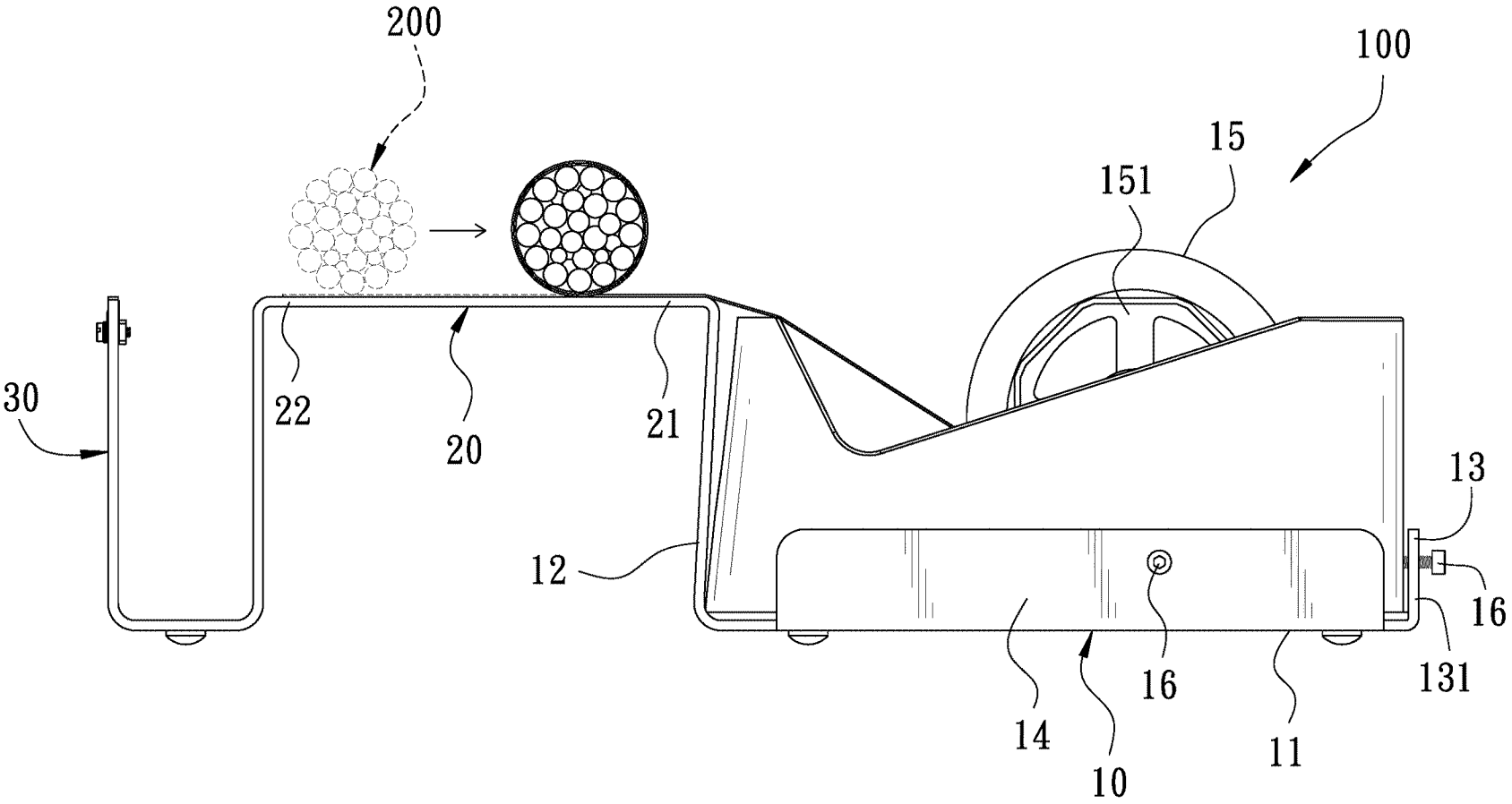
FIG. 5 is a schematic view of the first preferred embodiment of the desktop adhesive tape binding and cutting platform in a first using state in the present invention.
Figure 6:
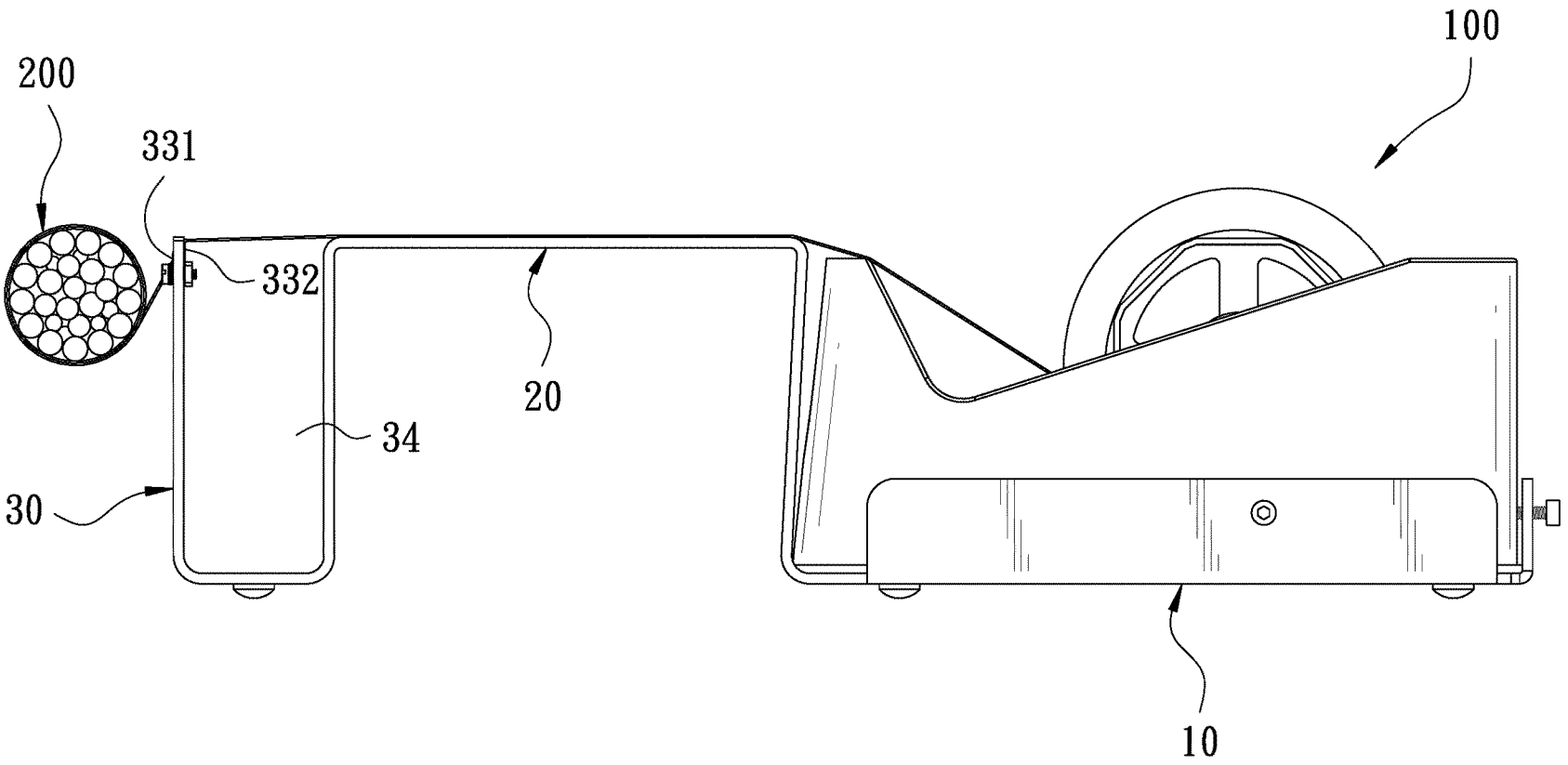
FIG. 6 is a schematic view of the first preferred embodiment of the desktop adhesive tape binding and cutting platform in a second using state in the present invention.
Figure 12:
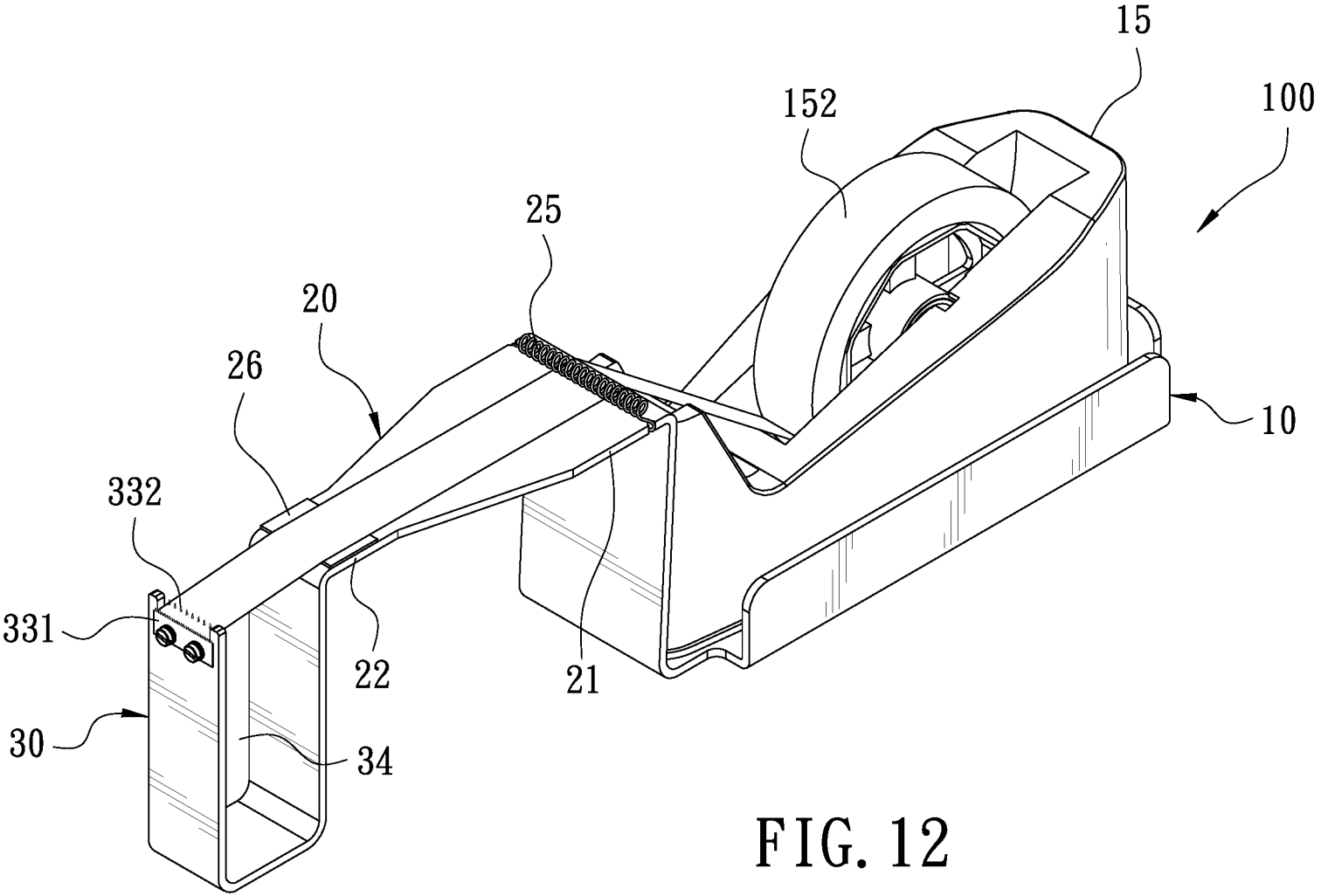
FIG. 12 is a schematic view of a seventh preferred embodiment of a desktop adhesive tape binding and cutting platform in the present invention.

Referring to FIG. 5, in use of the desktop adhesive tape binding and cutting platform 100, firstly, the adhesive tape holder 15 is installed on the fundamental base 11 and forced to be tightly fixed with the tape dispensing portion 10 via the forcing members 16 cooperating with the connecting plate 12. Next, the adhesive tape roll 152 is mounted on the rotating shaft 151, letting the adhesive face of the adhesive tape face upward and pulled out to be laid on the binding platform 20. Afterward, articles 200 to be bound, which can be vegetables, fruits or flowers, are continuously prepared and laid on the binding platform 20 at a location adjacent to the cutting portion 30 and begin carrying out binding operation toward another side in a winding around and sticking way. Lastly, the article 200 bound together with the adhesive tape is dragged to the cutting portion 30 to have the adhesive tape cut off by the cutting member 331 and further have the adhesive tape fixed in place by the fixing member 332, as shown in FIG. 6. The state that the adhesive tape is fixed with the fixing member 332 is shown in FIG. 12 and at this time, a user can once again pull up the adhesive tape through the space 34 to carry out another binding operation.

What is worth mentioning is that the fundamental base 11 can function to force the adhesive tape holder 15 to be tightly fixed in position via the connecting plate 12 and the positioning member 13 and the side plates 14 in cooperation with the forcing members 16; therefore, a user can optionally employ an adhesive tape holder with a suitable size. Moreover, the desktop adhesive tape binding and cutting platform 100 of this invention is provided with the first anti-skid piece 17 and the second anti-skid piece 35, able to elevate stability of the adhesive tape binding and cutting platform 100 during carrying out binding operation.

Figure 7:
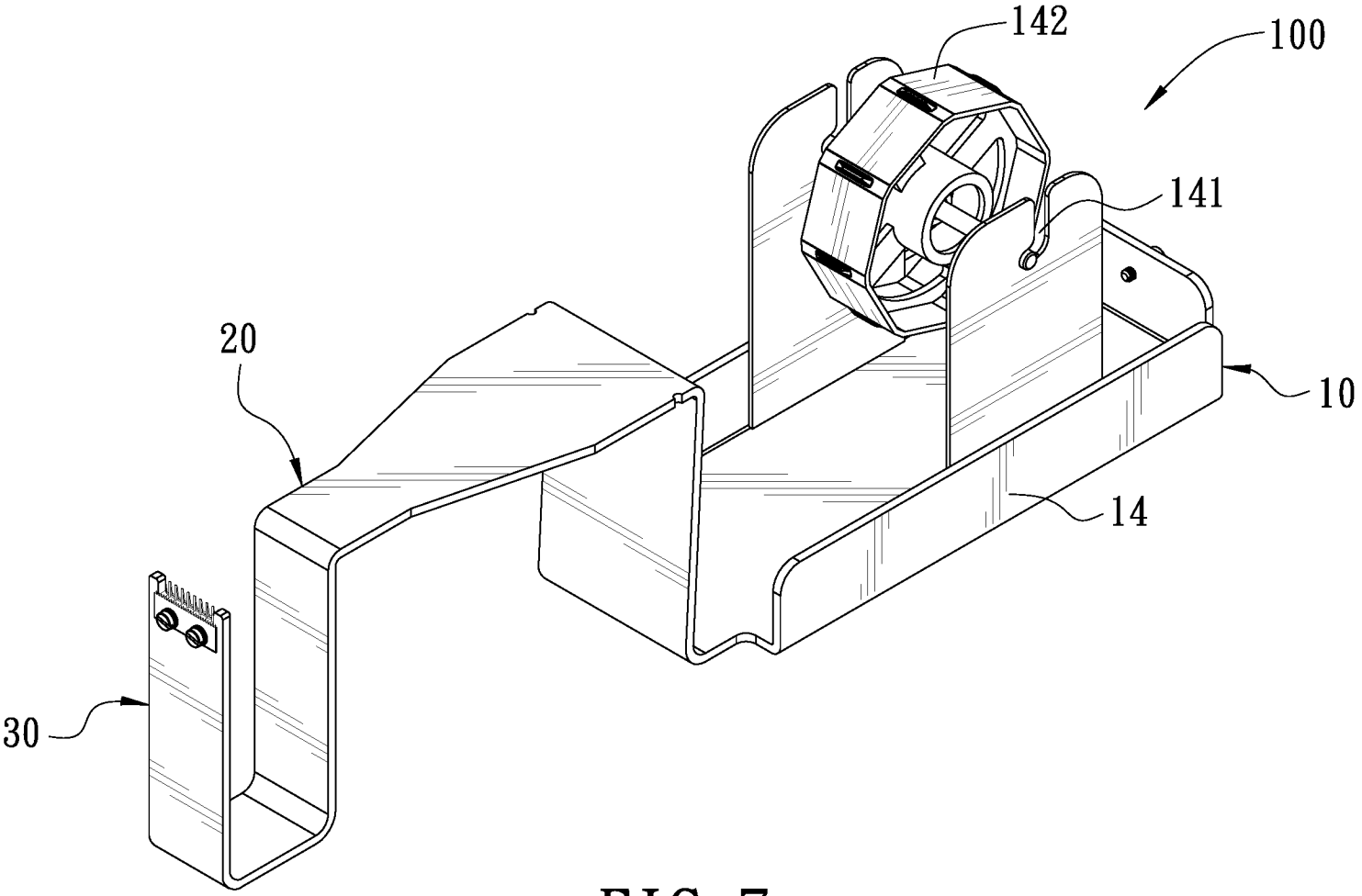
FIG. 7 is a perspective view of a second preferred embodiment of a desktop adhesive tape binding and cutting platform in the present invention.

A second preferred embodiment of a desktop adhesive tape binding and cutting platform 100 in the present invention, as shown in FIG. 7, is almost the same in structure as the first preferred embodiment, except that the two side plates 14 are respectively bored with a position-limiting notch 141 for pivotally connecting a rotating shaft 142 so that an adhesive tape roll can be installed around the rotating shaft 142 for carrying out binding operation.

Figure 8:
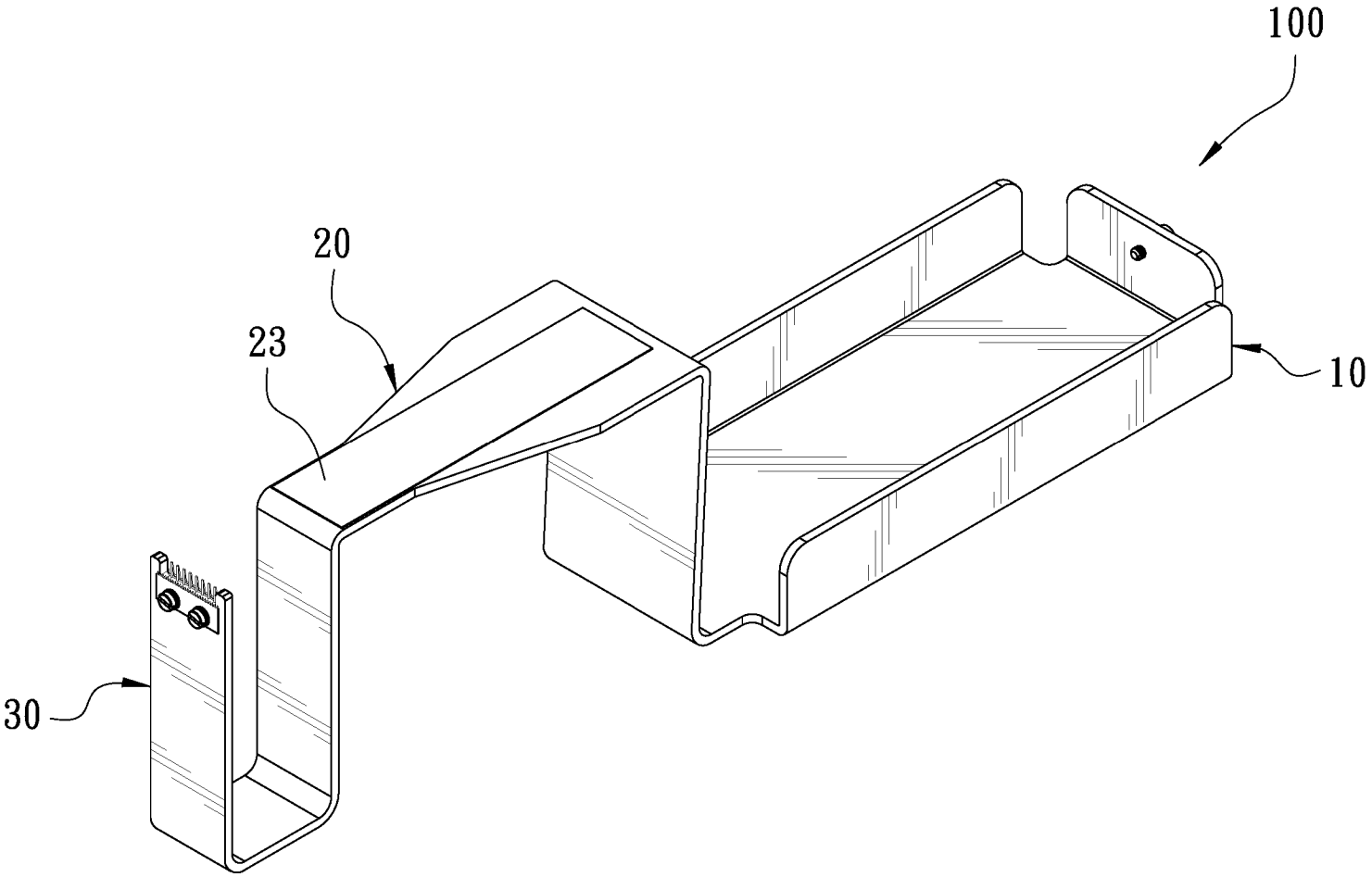
FIG. 8 is a perspective view of a third preferred embodiment of a desktop adhesive tape binding and cutting platform in the present invention.

A third preferred embodiment of a desktop adhesive tape binding and cutting platform 100, as shown in FIG. 8, has almost the same structure as that of the first preferred embodiment, except that the binding platform 20 has its topside further provided with a cushion 23 so as to increase coverage of binding operation and protect articles to be bound from being collided with each other.

Figure 9:
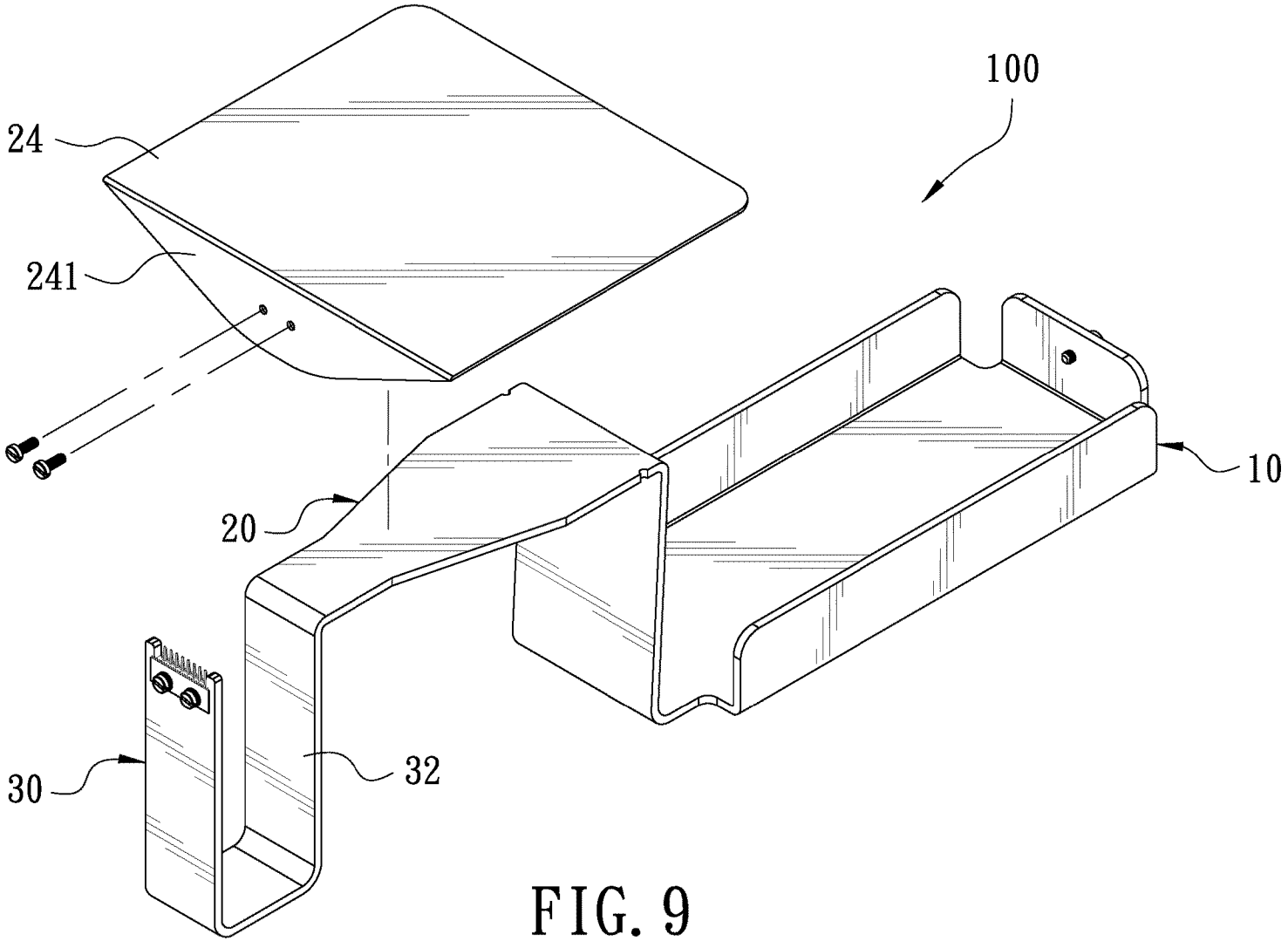
FIG. 9 is an exploded perspective view of a fourth preferred embodiment of a desktop adhesive tape binding and cutting platform in the present invention.

A fourth preferred embodiment of a desktop adhesive tape binding and cutting platform 100 in the present invention, as shown in FIG. 9, is to have an expansion platform 24 additionally provided on the topside of the binding platform 20 of the first preferred embodiment. The expansion platform 24 is larger than the binding platform 20 in top surface area and has one side provided with a fixing plate 241 to be secured at the first vertical plate 32 so that large-sized articles can conveniently be placed and bound on the expansion platform 24.

Figure 10:
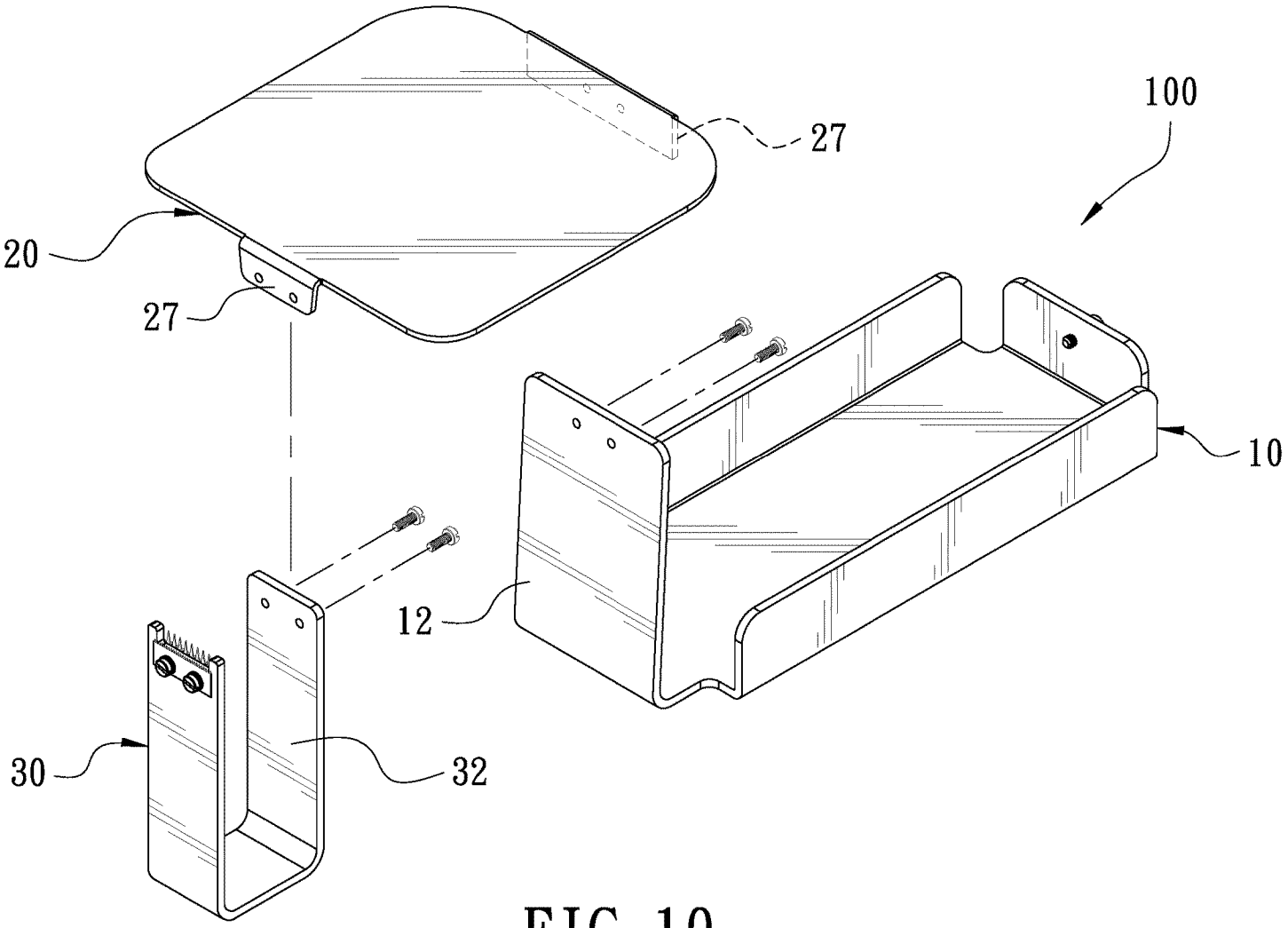
FIG. 10 is an exploded perspective view of a fifth preferred embodiment of a desktop adhesive tape binding and cutting platform in the present invention.

A fifth preferred embodiment of a desktop adhesive tape binding and cutting platform 100 in the present invention, as shown in FIG. 10, has almost the same structure as that of the fourth preferred embodiment, except that the tape dispensing portion 10, the binding platform 20 and the cutting portion 30 in the fifth preferred embodiment are formed independently, and the binding platform 20 has two sides respectively provided with a locking plate 27 to be respectively locked with the connecting plate 12 and the first vertical plate 32. Thus, a user can select the tape dispensing portion 10, the binding platform 20 and the cutting portion 30 that are respectively suitable in use and then assemble them together to make up the desktop adhesive tape binding and cutting platform 100.

Figure 11:
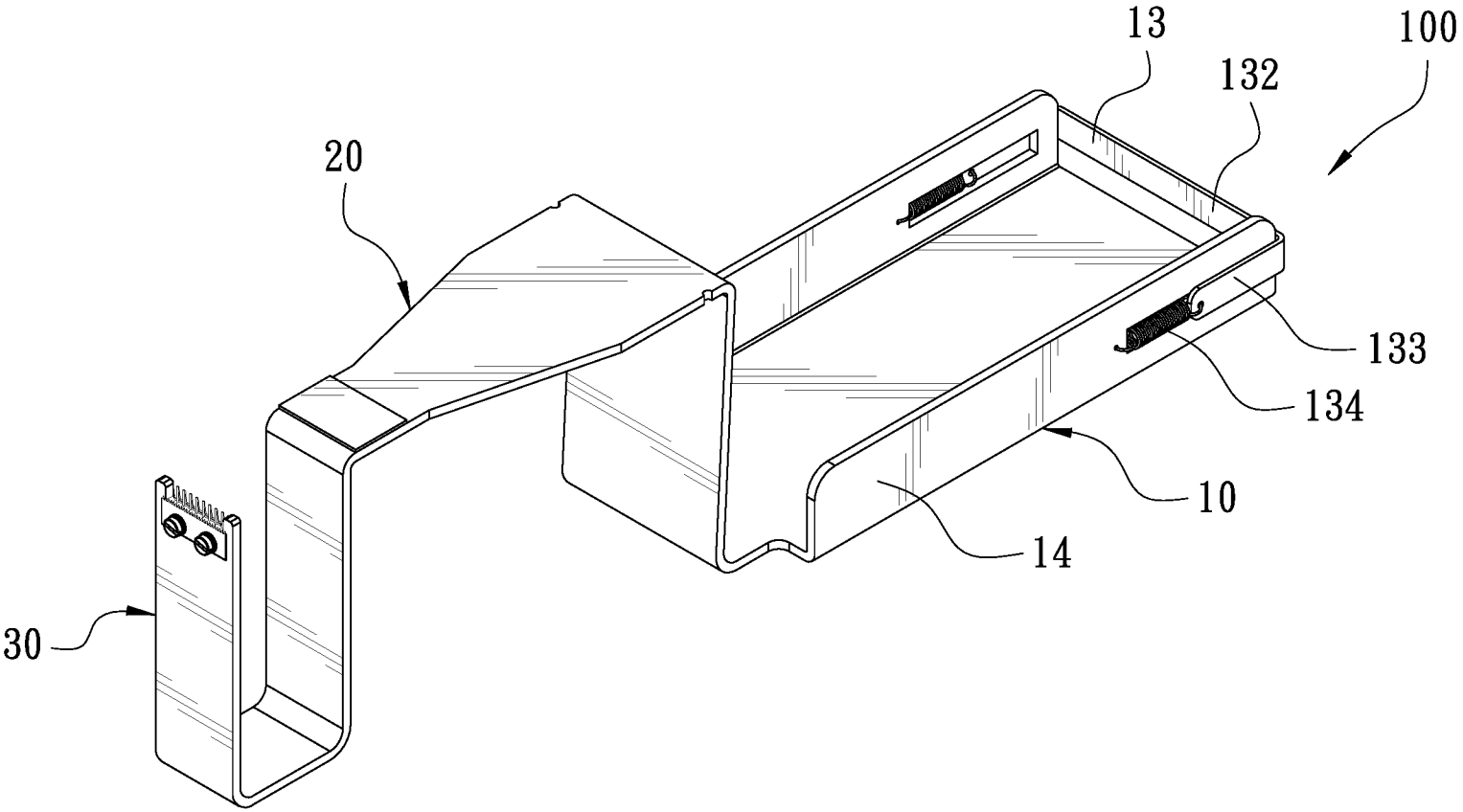
FIG. 11 is a perspective view of a sixth preferred embodiment of a desktop adhesive tape binding and cutting platform in the present invention.

A sixth preferred embodiment of a desktop adhesive tape binding and cutting platform 100 in the present invention, as shown in FIG. 11 is to have the positioning member 13 of the first preferred embodiment provided with a stop plate 132 instead of the positioning plate 131. The stop plate 132 has two sides respectively provided with an extension plate 133, and the two expansion plates 133 are respectively connected with an elastic member 134, which is a spring and whose fixed end is secured at the side plate 14. Thus, the adhesive tape holder 15 can be fixed in place by elastic force of the elastic members 134 of the stop plates 132 in cooperation with the connecting plate 12.

A seventh preferred embodiment of a desktop adhesive tape binding and cutting platform 100 in the present invention, as shown in FIG. 12, is almost the same in structure as the first preferred embodiment, except that the binding platform 20 has its topside provided with a first temporarily sticking member 25, which is a spring, at a location adjacent to the first connecting portion 21, and a second temporarily sticking member 26 at a location adjacent to the second connecting portion 22, the second temporarily sticking member 26 being a temporarily sticky sheet, such as static electricity paster or polyurethane glue. To use the desktop adhesive tape binding and cutting platform 100, firstly, have the adhesive tape pulled out from the first temporarily sticking member 25 and through the intermediate portion of the binding platform 20, thus able to carry out binding operation in sequence. Before carrying out binding operation once again, the adhesive tape can be fixed at the fixing member 332 and temporarily stuck to both the first temporarily sticking member 25 and the second temporarily sticking member 26 to avoid the adhesive tape being stuck backwards, able to elevate convenience in use.

While the preferred embodiments of the invention have been described above, it will be recognized and understood that various modifications may be made therein and the appended claims are intended to cover all such modifications that may fall within the spirit and scope of the invention.

What is claimed is:

1. A desktop adhesive tape binding and cutting platform comprising:

a tape dispensing portion comprising a fundamental base, said fundamental base having a first side provided with a connecting plate, said fundamental base adapted to receive an adhesive tape holder, said adhesive tape holder having a rotating shaft for use with an adhesive tape roll;

a binding platform having two ends respectively defined to be a first connecting portion and a second connecting portion, said first connecting portion connected with a free end of said connecting plate; and a cutting portion connected with said second connecting portion, said cutting portion having a free end disposed with a cutting member and a fixing member;

wherein said binding platform is disposed at height equal to or greater than said cutting member.

2. The desktop adhesive tape binding and cutting platform as claimed in claim 1, wherein said fundamental base has a second side provided with a positioning member, and two side plates spaced apart are disposed between said connecting plate and said positioning member, an adhesive tape holder installed among said connecting plate and said positioning member and said side plates, said adhesive tape holder pivotally provided with said rotating shaft, said rotating shaft fitted thereon with said adhesive tape roll.

3. The desktop adhesive tape binding and cutting platform as claimed in claim 2, wherein said connecting plate slants toward said fundamental base, and an angle less than 90 degrees is defined between said connecting plate and said fundamental base, said positioning member comprising a positioning plate, both said positioning member and said side plates respectively provided with a forcing member.

4. The desktop adhesive tape binding and cutting platform as claimed in claim 1, wherein a positioning member contains a stop plate, said stop plate having two sides respectively formed with an expansion plate, said expansion plates respectively connected with an elastic member, each said elastic member having a fixed end secured with said side plate.

5. The desktop adhesive tape binding and cutting platform as claimed in claim 1, wherein said fundamental base is provided with two side plates spaced apart, said side plates respectively formed with a position-limiting notch, said position-limiting notch pivotally connected with said rotating shaft, said rotating shaft mounted thereon with said adhesive tape roll.

6. The desktop adhesive tape binding and cutting platform as claimed in claim 1, wherein said cutting portion consists of a base plate, said base plate respectively and longitudinally formed with a first vertical plate and a second vertical plate, said first vertical plate connected with said second connecting portion, a space formed among said base plate and said first vertical plate and said second vertical plate, said second vertical plate having a free end provided with said cutting member and said fixing member and a retaining plate, said cutting member positioned at an outer side of said second vertical plate, said fixing member and said retaining plate provided at an inner side of said second vertical plate, said cutting member, said fixing member and said retaining plate firmly secured on said second vertical plate by screwing members.

7. The desktop adhesive tape binding and cutting platform as claimed in claim 6, wherein said cutting member is a cutting blade and said fixing member is an inserting-and-fixing blade, both said cutting member and said fixing member being serrated blades, a ratio of tooth height to tooth width of said cutting member being less than a ratio of tooth height to tooth width of said fixing member.

8. The desktop adhesive tape binding and cutting platform as claimed in claim 6, wherein said binding platform has topside further provided with an expansion platform whose top surface area is larger than that of said binding platform, said expansion platform having one side provided with a fixing plate, said fixing plate secured at said first vertical plate.

9. The desktop adhesive tape binding and cutting platform as claimed in claim 6, wherein said tape dispensing portion, said binding platform and said cutting portion are formed independently, said binding platform having two sides respectively provided with a locking plate, said locking plates respectively locked with said connecting plate and with said first vertical plate.

10. The desktop adhesive tape binding and cutting platform as claimed in claim 1, wherein said binding platform has one topside provided with a first temporarily sticking member at a location adjacent to said first connecting portion, said binding platform having another topside provided with a second temporarily sticking member at a location adjacent to said second connecting portion.

* * * * *